United States Patent [19]

Collier et al.

[11] Patent Number: 4,715,826

[45] Date of Patent: Dec. 29, 1987

[54] CIRCUIT BOARD CONNECTOR

[75] Inventors: John C. Collier, Skelmersdale; Keith Davies, St. Helens, both of England

[73] Assignee: BICC Public Limited Company, London, England

[21] Appl. No.: 903,384

[22] Filed: Sep. 3, 1986

[30] Foreign Application Priority Data

Sep. 3, 1985 [GB] United Kingdom ..... 8521843

[51] Int. Cl.[4] ..... H01R 4/24

[52] U.S. Cl. ..... 439/438

[58] Field of Search ..... 339/95 R, 176 MF, 176 MP

[56] References Cited

U.S. PATENT DOCUMENTS

| | | | |
|---|---|---|---|
| 3,772,179 | 11/1973 | Beer | 339/95 R |
| 3,790,916 | 2/1974 | Keitel | 339/95 R |
| 3,848,952 | 11/1974 | Tighe, Jr. | 339/176 MP |
| 3,853,382 | 12/1974 | Lazar . | |
| 3,920,303 | 11/1975 | Pittman et al. | 339/176 MP |

FOREIGN PATENT DOCUMENTS

| | | |
|---|---|---|
| 0158413 | 10/1985 | European Pat. Off. . |
| 82/01280 | 4/1982 | PCT Int'l Appl. . |
| 83/01867 | 5/1983 | PCT Int'l Appl. . |
| 1569838 | 6/1980 | United Kingdom . |
| 1572363 | 7/1980 | United Kingdom . |

*Primary Examiner*—Joseph H. McGlynn
*Attorney, Agent, or Firm*—Parkhurst & Oliff

[57] ABSTRACT

An edge connector (1) comprises a housing (2) having an aperture (3) in which an edge (6) of a circuit board (7) is received. One or more connector pins (12) (13) extending from the housing each have a sharp-edged contact region (19), plated with a ductile metallic material such as tin or lead, and capable of penetrating and deforming a similarly plated contact pad (20) to establish a low resistance electrical connection therebetween. The housing (2) and the circuit board (7) are pivotable with respect to one another between a first position in which there is clearance between the connector pins (12) (13) and the contact pads (20) present on the circuit board, and a second position in which they are in electrical contact one with the other. Securing means such as resilient clips (25) (26) (30) (34) hold the circuit board with respect to the housing (2) in the second position.

7 Claims, 9 Drawing Figures

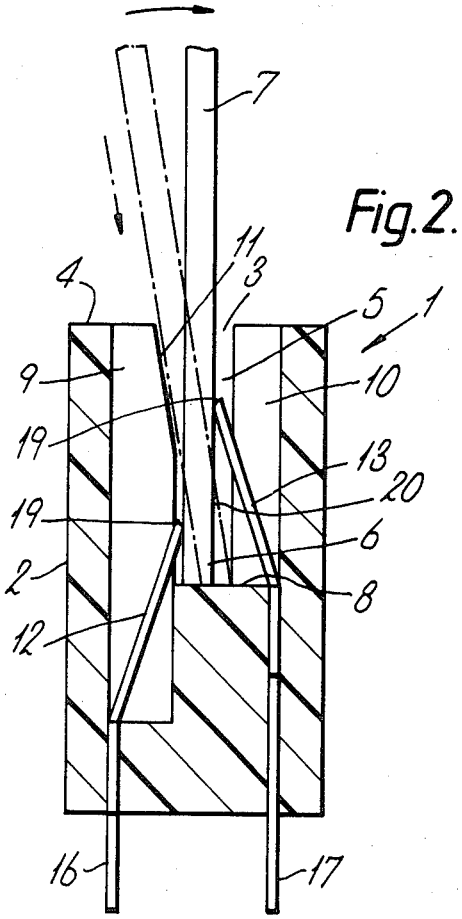
Fig.2.
Fig.3.
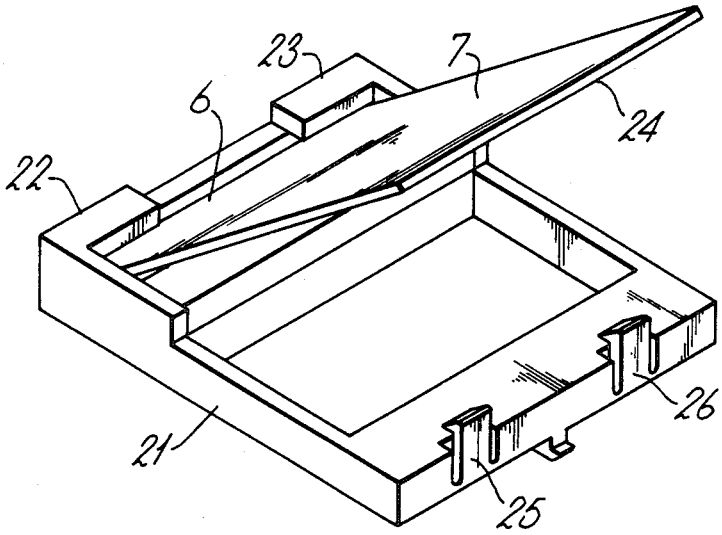

CIRCUIT BOARD CONNECTOR

This invention relates to an electrical connector comprising a plurality of connector pins and especially, though not exclusively, to an electrical connector suitable for use with closely spaced corresponding contact pads on a printed circuit board.

Electrical connection between an electrical connector and corresponding contact pads on a printed circuit board may be effected either on the planar surface of the printed circuit board or on, or close to, the edge of the printed circuit board and shall be referred to hereinafter as a surface connection or edge connection respectively.

EP 0158413 describes an edge connector in which a circuit board is inserted and then pivoted to bring conductive portions of the board into contact with the pins of the connector. The present invention provides an improvement to this type of edge connector.

Accordingly there is provided an electrical edge connector for a circuit board having an edge with one or more contact pads thereon, the connector comprising an insulating housing having an aperture adapted to receive an edge of a circuit board, one or more metallic connector pins extending from the housing, the one or more connector pins each having a sharp-edged male contact region plated with a ductile metallic material, each sharp-edged region being capable of penetrating and deforming a similarly plated contact pad to establish a low resistance electrical connection therebetween, the connector being such that a circuit board and the housing are pivotable with respect to one another between a first position in which there is clearance between the connector pins and contact pads present on the circuit board, and a second position in which the connector pins and the contact pads are in electrical contact one with the other, and securing means adapted to hold a circuit board with respect to the housing in the second position.

Sharp-edged contacts are known from U.S. Pat. No. 3,853,382. However the use of such sharp-edged contacts in edge connectors has heretofor been considered impracticable. This is because the damage caused to a circuit board by the repeated insertion and removal of an edge connector with sharp-edged contacts was thought to be unacceptable. Accordingly their use has previously been restricted to surface connections. By employing a pivoting arrangement, an edge connector is provided which offers the advantage of sharp-edged contacts and yet may be repeatedly connected to and disconnected from a circuit board without causing damage thereto.

The securing means is preferably releasable, and is conveniently adapted for finger-release. Preferably the securing means includes a resilient clip arrangement. The housing preferably includes first and second latch members, the first latch member defining one periphery of the aperture and being adapted to locate adjacent an edge of a circuit board, the second latch member being adapted to engage a part of a circuit board remote from the said edge, at least one of the first and second latch members comprising a resilient clip.

Conveniently the first latch member comprises a resilient clip, the arrangement being such that the second latch member is engaged with the remote part of the circuit board, and the connector and circuit board are pivoted one with respect to the other about the second latch member to clip the edge of the circuit board over the first latch member and into the aperture in the housing. Alternatively the second latch member comprises a resilient clip, the arrangement being such that an edge of the circuit board is inserted into the aperture to engage the first latch member, and the connector and the circuit board are then pivoted one with respect to the other to clip the second latch member over the part of the circuit board remote from the said edge. Conveniently the first latch member includes an angled face adapted to guide a circuit board into the aperture.

Whichever arrangement is employed, the second latch member is conveniently adapted to engage in a locating hole provided in the circuit board. Alternatively the second latch member is conceivably adapted to engage an edge of the circuit board other than the said edge, i.e. the opposite edge of the circuit board, or possibly one or both of the side edges thereof.

The body of the insulating housing preferably comprises a base portion and two limb portions which extend from the base to define the walls of a substantially U-shaped channel. Preferably each connector pin extends through the base portion of the insulating housing and into the channel such that the male contact portion of each pin is exposed in said channel. In this case, the male contact portion of each pin is preferably directed towards a plane extending longitudinally along the middle of the channel.

The invention further resides in the combination of an electrical edge connector and a circuit board, the circuit board having an edge with one or more contact pads thereon, the contact pads being plated with a ductile metallic material; the connector comprising an insulating housing having an aperture adapted to receive the edge of the circuit board, one or more metallic connector pins extending from the housing, the one or more connector pins each having a sharp-edged male contact region plated with a ductile metallic material, the connector being such that the circuit board and housing are pivotable with respect to one another between a first position in which there is clearance between the connector pins and the contact pads, and a second position in which the connector pins and the contact pads are in electrical contact one with the other, the arrangement being such that the pivoting of the housing and circuit board into their second position causes each sharp-edged male contact region to penetrate and deform the plating of one of the one or more contact pads to provide a low resistance electrical connection therebetween, and there is provided securing means for holding the circuit board with respect to the housing in the second position.

The invention will now be further described, by way of example only, with reference to the accompanying drawings, in which:

FIG. 2 is a cross-sectional side view of the connector of FIG. 1;

FIG. 3 is a perspective view of an alternative embodiment of connector;

Figure 4A:
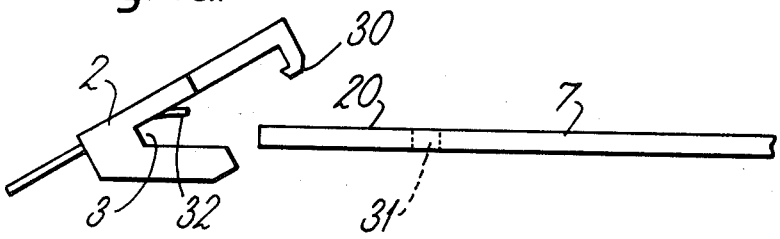
Figure 4B:
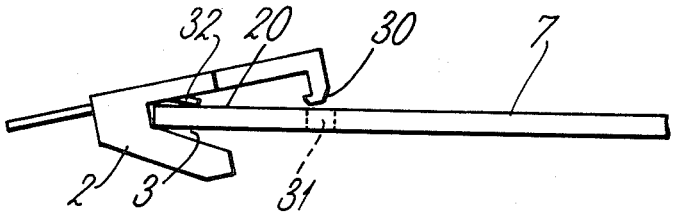
Figure 4C:
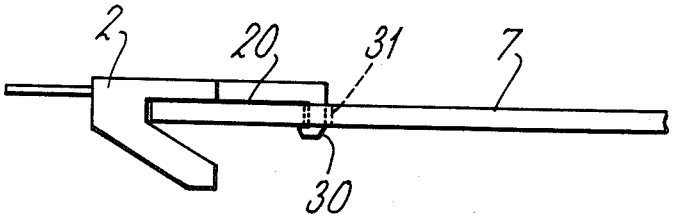
Figure 5A:
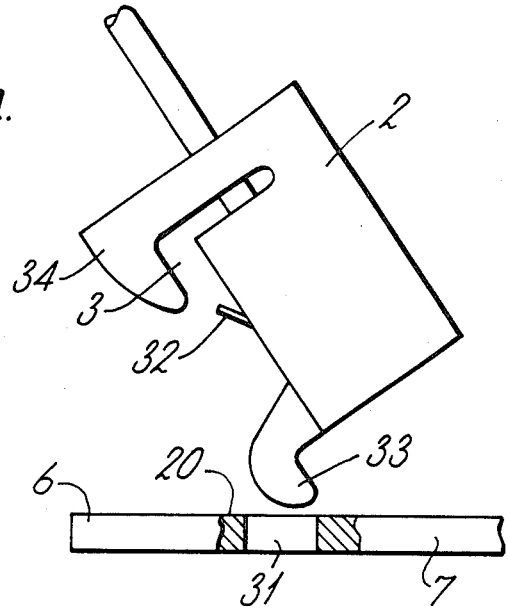
Figure 5B:
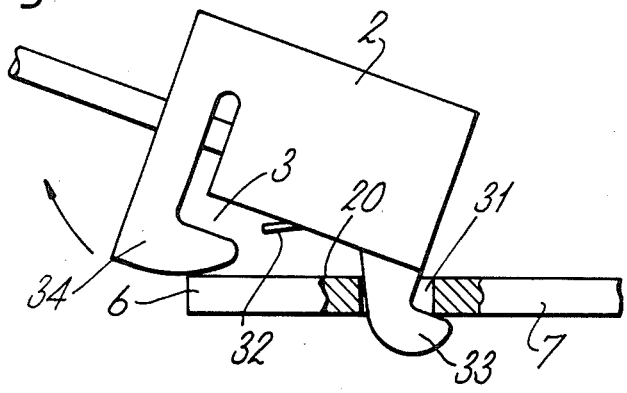
Figure 5C:
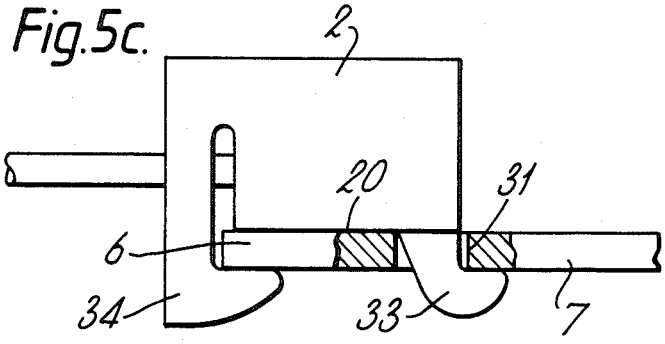

FIGS. 4*a*, 4*b* and 4*c* are schematic views of another alternative embodiment of connector, showing various stages during its location on to a circuit board; and FIGS. 5*a*, 5*b* and 5*c* are schematic views of yet another alternative embodiment of connector, showing various stages during its location on to a circuit board.

Figure 1:
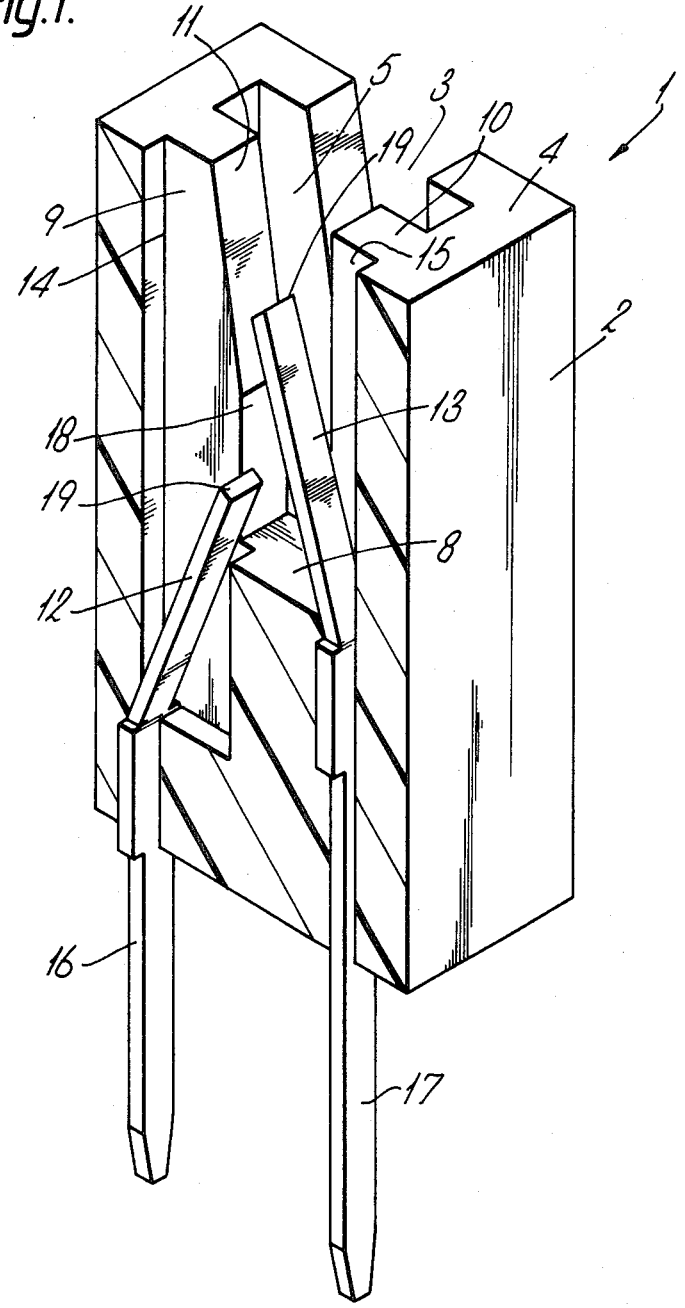
FIG. 1 is a perspective sectional view of an edge connector according to the invention.

Referring to FIGS. 1 and 2, an edge connector shown generally at 1 comprises a moulded plastic housing 2 having an aperture 3 in one face 4 thereof. The aperture 3 defines the entrance to a chamber 5 in which the edge 6 of a circuit board 7 can be accommodated.

The chamber is formed by a base 8 and two side walls 9 and 10, one side wall 9 having a sloped face 11. The housing 2 also contains two contact pins 12 and 13 which are received in recesses 14 and 15 and extend into the chamber 5. The lower portions of the contact pins extend from the bottom of the housing as shown at 16 and 17.

The upper portions of the contact pins 12 and 13 are angled one towards the other, and differ in length so as to define a gap 18 therebetween. The end face of each contact pin is formed as a cutting edge 19 and is plated with a ductile metallic material such as tin or lead.

In operation, a circuit board 7 is introduced into the chamber 5 via the aperture 3. The edge 6 of the circuit board 7 has conductive contact portions 20 on the faces thereof, the conductive portions being similarly plated with a ductile metallic material such as tin or lead. The circuit board is inserted at an angle so that the edge 6 is received in the gap 18 between the contact pins 12 and 13. The sloped face 11 serves as a guide to assist in the insertion of the circuit board.

When the circuit board abuts the base 8, it is pivoted as shown in FIG. 2 into an upright position bringing the cutting edges 19 of the contact pins 12 and 13 into engagement wih the contact portions 20 of the circuit board. The cutting edges 19 deform and penetrate the surface of the contact portions 20, thereby displacing any oxidised surface layer that may have formed thereon. In this way a low resistance electrical connection is made between the contact pins 12 and 13 and the circuit board 7. Securing means, which will later be described in more detail, hold the circuit board in its upright position, in engagement with the contact pins 12 and 13.

FIG. 3 shows an edge connector incorporating securing means, the connector including a frame shown generally at 21 in which the circuit board 7 is received. The connector comprises a first latch mechanism in the form of bosses 22 and 23 which constitute one boundary of the aperture in which the edge of the circuit board 7 is received. As before the circuit board is inserted into the aperture at an angle, and then pivoted until the opposite edge 24 is received and held by a second latch mechanism in the form of clips 25 and 26. The circuit board 7 is then held between the bosses 22 and 23 which act on one edge 6, and the clips 25 and 26 which act on the opposite edge 24.

FIGS. 4*a*, 4*b* and 4*c* show an edge connector in which a clip 30 engages, not against the opposite edge of the circuit board, but in a locating hole 31 specifically provided for this purpose. FIG. 4*a* shows how the circuit board 7 is inserted into the aperture 3 at an angle to the connector housing 2. FIG. 4*b* shows in this instance the pivoting of the housing 2 with respect to the circuit board 7. This brings sharp-edged contact pins 32 into engagemet with conductive contact portions 20 on the circuit board. Further pivoting of the housing, as shown in FIG. 4*c*, results in the clip 30 engaging in the locating hole 31 to lock the housing 2 in position on the circuit board.

FIGS. 5*a*, 5*b* and 5*c* show an alternative embodiment of edge connector which also requires a locating hole 31 specifically provided in the circuit board. The housing includes a first latching mechanism in the form of a resilient clip 34, located adjacent aperture 3 in which the edge of the circuit board 7 is received. A second latching mechanism is also present in the form of a shaped hook portion 33.

To attach the connector to the circuit board 7, the hook portion 33 is inserted into the locating hole 31 as shown in FIG. 5*a*. Then the housing 2 is pivoted about the hook portion 33 as shown in FIG. 5*b* to bring the clip 34 into engagement with the edge 6 of the circuit board 7. Further pivoting of the housing results in the edge of the circuit board snapping into the aperture 3 to be held by the clip 34. In this position, sharp-edged contacts 32 are in engagement with conductive contact portions 20 on the circuit board. This is the position as shown in FIG. 5*c*.

Whichever embodiment of connector is employed, the pivoting action allows sharp-edged contacts to be used in an edge connector without causing damage to the circuit board by scraping the surface thereof as the connector is inserted or removed.

What we claim as our invention is:

1. An electrical edge connector for a circuit board having an edge with at least one contact pad present on or adjacent the edge; the connector comprising an insulating housing, the housing defining an aperture for receiving an edge of a circuit board; at least one metallic connector pin extending from the housing, the connector pin having a sharp-edged male contact region plated with a ductile metallic material, said sharp-edged region being capable of penetrating and deforming a similarly plated contact pad to establish a low resistance electrical connection therebetween; wherein the connector is such that a circuit board and the housing are pivotable with respect to one another between a first position in which there is clearance between the connector pin and the contact pad present on the circuit board, and a second position in which the connector pin penetrates and deforms said contact pad such that the connector pin and the contact pad are in low resistance electrical contact one with the other; and there is provided securing means for holding a circuit board with respect to the housing in the second position.

2. A connector according to claim 1 wherein the securing means includes a resilient clip arrangement.

3. A connector according to claim 2 wherein the housing includes first and second latch members, the first latch member defining one periphery of the aperture and being adapted to locate adjacent an edge of a circuit board, the second latch member being adapted to engage a part of a circuit board remote from the said edge, at least one of the first and second latch members comprising a resilient clip.

4. A connector according to claim 3 wherein the first latch member comprises a resilient clip, the arrangement being such that the second latch member is engaged with the remote part of the circuit board, and the connector and circuit board are then pivoted one with respect to the other about the second latch member to clip the edge of the circuit board over the first latch member and into the aperture in the housing.

5. A connector according to claim 3 wherein the second latch member comprises a resilient clip, the arrangement being such that an edge of the circuit board is inserted into the aperture to engage the first latch member, and the connector and the circuit board are then pivoted one with respect to the other to clip the second latch member over the part of the circuit board remote from the said edge.

6. A connector according to claim 5 wherein the first latch member includes an angled face adapted to guide a circuit board into the aperture.

7. In combination, an electrical edge connector and a circuit board, the circuit board having an edge and at least one contact pad present on or adjacent the edge; the contact pad being plated with a ductile metallic material; the connector comprising an insulating housing, the housing defining an aperture for receiving the edge of the circuit board, at least one metallic connector pin extending from the housing, the connector pin having a sharp-edged male contact region plated with a ductile metallic material; wherein the connector is such that the circuit board and the housing are pivotable with respect to one another between a first position in which there is clearance between the connector pin and the contact pad, and a second position in which the connector pin and the contact pad are in electrical contact one with the other, the arrangement being such that the pivoting of the housing and circuit board into the second position causes the sharp-edged male contact region to penetrate and deform the plating of the contact pad to provide a low resistance electrical connection therebetween, and there is provided securing means for holding the circuit board with respect to the housing in the second position.

* * * * *